US005943021A

United States Patent [19]

Hayes et al.

[11] Patent Number: 5,943,021

[45] Date of Patent: Aug. 24, 1999

[54] SWIVEL ANTENNA WITH PARASITIC TUNING

[75] Inventors: Gerard James Hayes, Wake Forest; Kim Rutkowski, Raleigh, both of N.C.

[73] Assignee: Ericsson Inc., Research Triangle Park, N.C.

[21] Appl. No.: 09/128,094

[22] Filed: Aug. 3, 1998

[51] Int. Cl.[6] ..... H01Q 1/24

[52] U.S. Cl. ..... 343/702

[58] Field of Search ..... 343/702

[56] References Cited

U.S. PATENT DOCUMENTS 5,554,996 9/1996 Chatzipetros ..... 343/702

5,572,223 11/1996 Phillips et al. ..... 343/702

*Primary Examiner*—Don Wong

*Assistant Examiner*—Hoang Nguyen

*Attorney, Agent, or Firm*—Myers Bigel Sibley & Sajovec, P.A.

[57] ABSTRACT

A radiotelephone antenna system includes a parasitic tuning element disposed on a radiotelephone housing so as to be located adjacent a swivel antenna when the antenna is in a stored position. When in a stored position, the antenna overlies at least a portion of the parasitic tuning element. The parasitic tuning element is coupled to the swivel antenna to tune the swivel antenna to a first frequency band and to match an impedance of the antenna with an impedance of the radiotelephone transceiver. Accordingly, a radiotelephone can operate satisfactorily even when a swivel antenna is in a stored position.

37 Claims, 9 Drawing Sheets

SWIVEL ANTENNA WITH PARASITIC TUNING

FIELD OF THE INVENTION

The present invention relates generally to radiotelephones and, more particularly, to radiotelephone antennas.

BACKGROUND OF THE INVENTION

Radiotelephones generally refer to communications terminals which provide a wireless communications link to one or more other communications terminals. Radiotelephones may be used in a variety of different applications, including cellular telephone, land-mobile (e.g., police and fire departments), and satellite communications systems.

Radiotelephones and other communication devices are undergoing miniaturization. Indeed, many of the contemporary radiotelephone models are less than 11–12 centimeters in length. As a result, antennas that swivel or pivot from a stored position adjacent to the housing of a radiotelephone to a position extending outwardly from the housing are becoming increasingly attractive to radiotelephone manufacturers. Swivel antennas can achieve good radiation performance when in outwardly extended positions. Unfortunately, these swivel antennas can become severely de-tuned, and even rendered inoperable, because of impedance mismatching, when in a stored position adjacent the housing of a radiotelephone. As a result, radiotelephones may not be operable when a swivel antenna is in a stored position.

Impedance mismatching may occur due to the close proximity of an antenna to a radiotelephone housing and/or to various ground planes within a radiotelephone. Impedance matching components and/or circuitry can be added to a radiotelephone to match the impedance of a swivel antenna when in a stored position. However, incorporating additional matching components and/or circuitry may be somewhat expensive and available space within radiotelephones may be somewhat limited.

It would be desirable for radiotelephones incorporating swivel antennas to be operable when the antenna is in a stored position. Accordingly, the reception of paging signals could be enhanced. In addition, to facilitate reducing costs associated with manufacturing radiotelephones, and to accommodate miniaturization, it would be desirable to utilize swivel antennas without requiring additional impedance matching components and/or circuitry.

SUMMARY OF THE INVENTION

It is, therefore, an object of the present invention to provide swivel antennas that are sufficiently tuned when in a stored position adjacent a radiotelephone housing to allow a radiotelephone to operate satisfactorily.

It is another object of the present invention to facilitate reducing costs associated with radiotelephone manufacturing.

It is yet another object of the present invention to facilitate miniaturization efforts with respect to radiotelephones and other communication devices.

These and other objects of the present invention are provided by antenna systems for electronic devices, such as radiotelephones, wherein a parasitic tuning element is disposed on or within a radiotelephone housing so as to be located adjacent a swivel antenna when the antenna is in a stored position. Preferably, a swivel antenna, when in a stored position, overlies at least a portion of the parasitic tuning element. The parasitic tuning element is coupled to the swivel antenna to tune the swivel antenna to a first frequency band and to match an impedance of the swivel antenna with an impedance of the radiotelephone transceiver. Accordingly, a radiotelephone can operate satisfactorily even when the swivel antenna is in a stored position.

The present invention may be utilized with single frequency and multiple frequency band antennas. Multiple parasitic elements may be configured to couple with respective multiple radiating elements located on a swivel antenna. For example, a multiple frequency band antenna configured to resonate at 800 MHz and 1900 MHz when in an operating position can also operate satisfactorily at 800 MHz and 1900 MHz when in a stored position adjacent the housing of a radiotelephone.

Parasitic tuning elements having various shapes and configurations may be utilized, according to the present invention. For example, a parasitic tuning element may have a meandering configuration that extends between the keys of a radiotelephone keypad or that uses other available space on or within a radiotelephone housing. Furthermore, a parasitic tuning element may be disposed within the housing of a radiotelephone or within the housing material.

According to another aspect of the present invention, an antenna may be disposed on or within the flip cover of a flip-style radiotelephone. The flip cover is hinged to the housing and is movable between a closed position wherein the flip cover overlies at least a portion of a face of the housing, and an open position wherein the housing face is uncovered. An antenna is disposed on or within the flip cover. One or more parasitic tuning elements may be disposed on or within the radiotelephone housing so as to underlie the antenna when the flip cover is in a closed position. The parasitic tuning element is coupled to the antenna to tune the antenna to a first frequency band and to match an impedance of the antenna with an impedance of the transceiver when the flip cover is in a closed position.

According to another aspect of the present invention, a flip cover of a flip-style radiotelephone may include one or more parasitic tuning elements disposed on or within a surface of the flip cover. The flip cover is hinged to the housing of a radiotelephone and is movable between a closed position wherein the flip cover overlies at least a portion of a face of the housing, and an open position wherein the housing face is uncovered. An antenna may be movably mounted to the housing such that the antenna pivots along a predetermined path of rotation from a stored position overlying the flip cover when the flip cover is in the closed position to an operating position extended away from the housing and spaced apart from the flip cover when the flip cover is in the open position.

At least one parasitic tuning element is disposed on or within the flip cover so as to be located adjacent the antenna when the antenna is in the stored position. Each parasitic tuning element is coupled to the antenna to tune the antenna to a first frequency band and to match an impedance of the antenna with an impedance of the transceiver when the flip cover is in the closed position.

Radiotelephones with swivel antennas incorporating parasitic tuning elements according to the present invention are advantageous because the antenna can be prevented from becoming de-tuned when stored in a position adjacent the radiotelephone housing. Thus, the radiation performance of swivel antennas can be optimized for both stored and operating positions. As a result, performance of radiotelephones, particularly paging performance, may be enhanced.

BRIEF DESCRIPTION OF THE DRAWINGS

The accompanying drawings, which are incorporated in and constitute a part of the specification, illustrate embodiments of the invention and, together with the description, serve to explain principles of the invention.

DETAILED DESCRIPTION OF THE INVENTION

The present invention now will be described more fully hereinafter with reference to the accompanying drawings, in which preferred embodiments of the invention are shown. This invention may, however, be embodied in many different forms and should not be construed as limited to the embodiments set forth herein; rather, these embodiments are provided so that this disclosure will be thorough and complete, and will fully convey the scope of the invention to those skilled in the art. Like numbers refer to like elements throughout.

Figure 1:
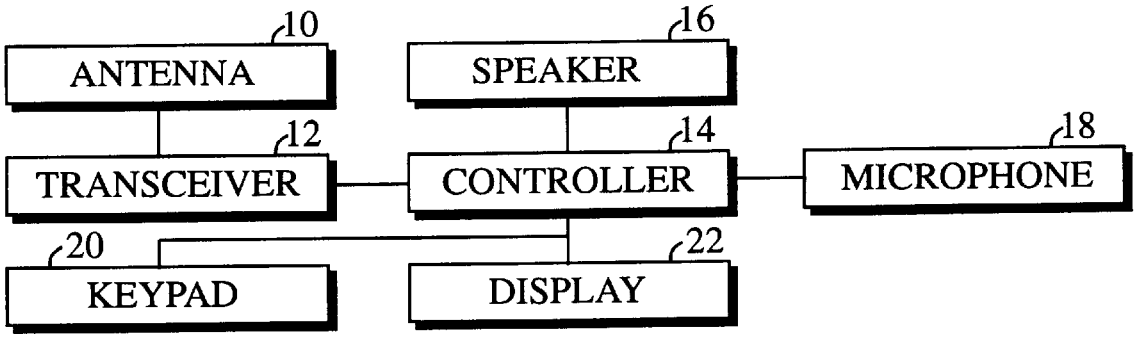
FIG. 1 (PRIOR ART)
FIG. 1 is a schematic illustration of a conventional arrangement of electronic components for enabling a radiotelephone to transmit and receive telecommunications signals.

A conventional arrangement of electronic components that enable a radiotelephone to transmit and receive radiotelephone communication signals is shown schematically in FIG. 1, and is understood by those skilled in the art of radiotelephone communications. An antenna 10 for receiving and transmitting radiotelephone communication signals is electrically connected to a radio-frequency transceiver 12 that is further electrically connected to a controller 14, such as a microprocessor. The controller 14 is electrically connected to a speaker 16 that transmits a remote signal from the controller 14 to a user of a radiotelephone. The controller 14 is also electrically connected to a microphone 18 that receives a voice signal from a user and transmits the voice signal through the controller 14 and transceiver 12 to a remote device. The controller 14 is electrically connected to a keypad 20 and display 22 that facilitate radiotelephone operation. Other elements of radiotelephones are conventional and need not be described herein.

As is known to those skilled in the art of communications devices, an antenna is a device for transmitting and/or receiving electrical signals. A transmitting antenna typically includes a feed assembly that induces or illuminates an aperture or reflecting surface to radiate an electromagnetic field. A receiving antenna typically includes an aperture or surface focusing an incident radiation field to a collecting feed, producing an electronic signal proportional to the incident radiation. The amount of power radiated from or received by an antenna depends on its aperture area and is described in terms of gain.

Conventional radiotelephones employ an antenna which is electrically connected to a transceiver operably associated with a signal processing circuit positioned on an internally disposed printed circuit board. To radiate radio frequency (RF) energy with minimum loss, or to pass along received RF energy to a radiotelephone receiver with minimum loss, the transceiver and the antenna are preferably interconnected such that their respective impedances are substantially "matched," i.e., electrically tuned to filter out or compensate for undesired antenna impedance components to provide a 50 Ohm (Ω) (or desired) impedance value at the circuit feed. Impedance matching systems are well known in this art and need not be discussed further.

Figure 2A:
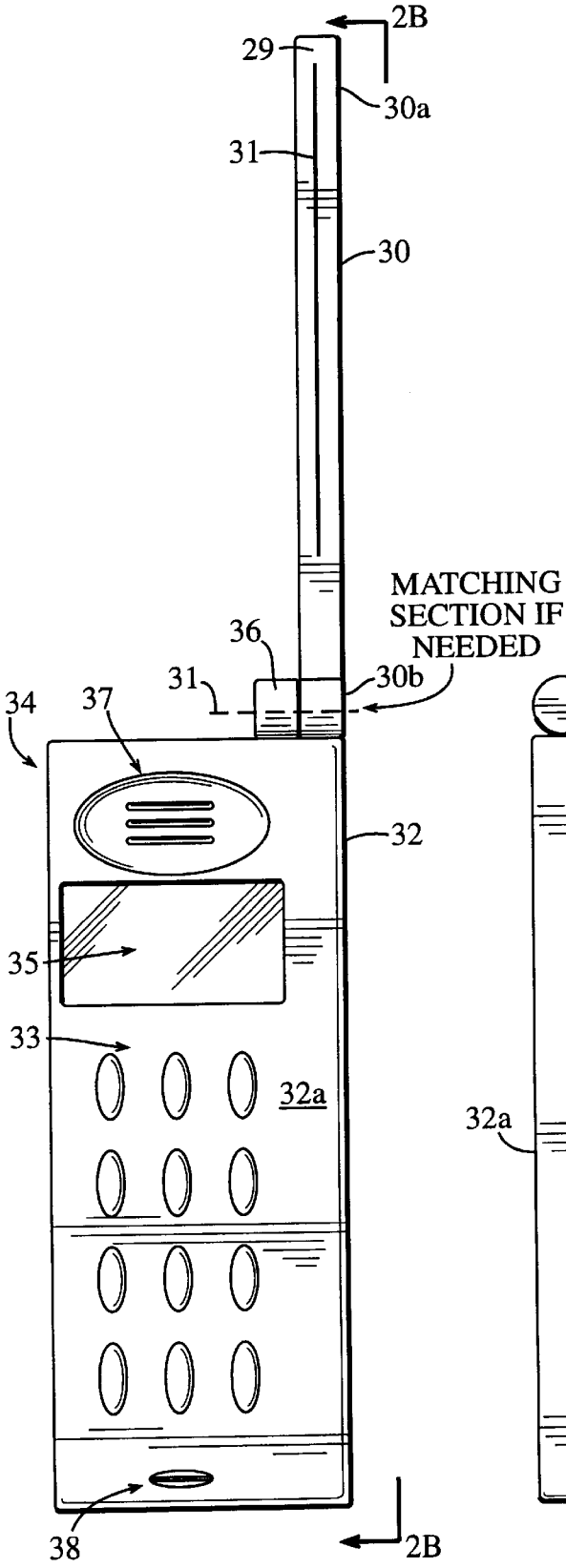
FIG. 2A (PRIOR ART)
FIG. 2A illustrates a swivel radiotelephone antenna in an operational position.
Figure 2B:
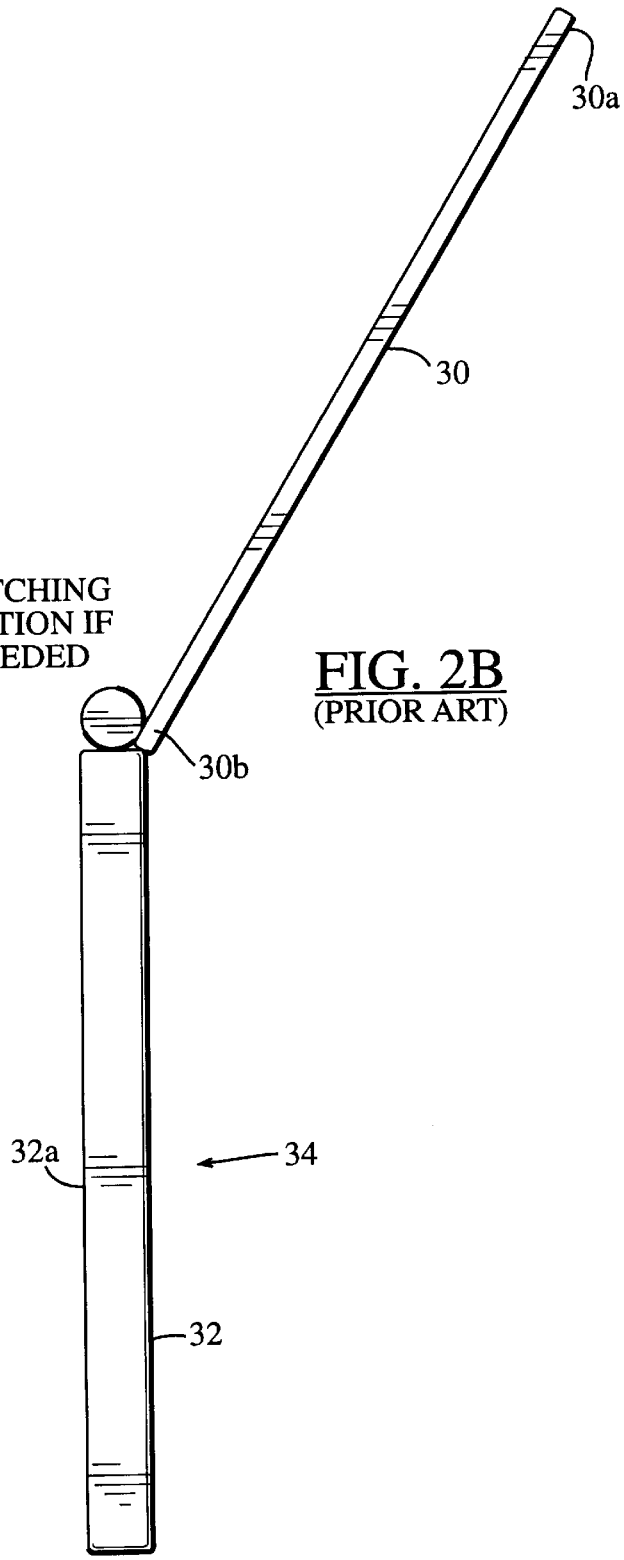
FIG. 2B (PRIOR ART)
FIG. 2B is a side elevational view of the antenna of FIG. 2A taken along lines 2B—2B.
Figure 3A:
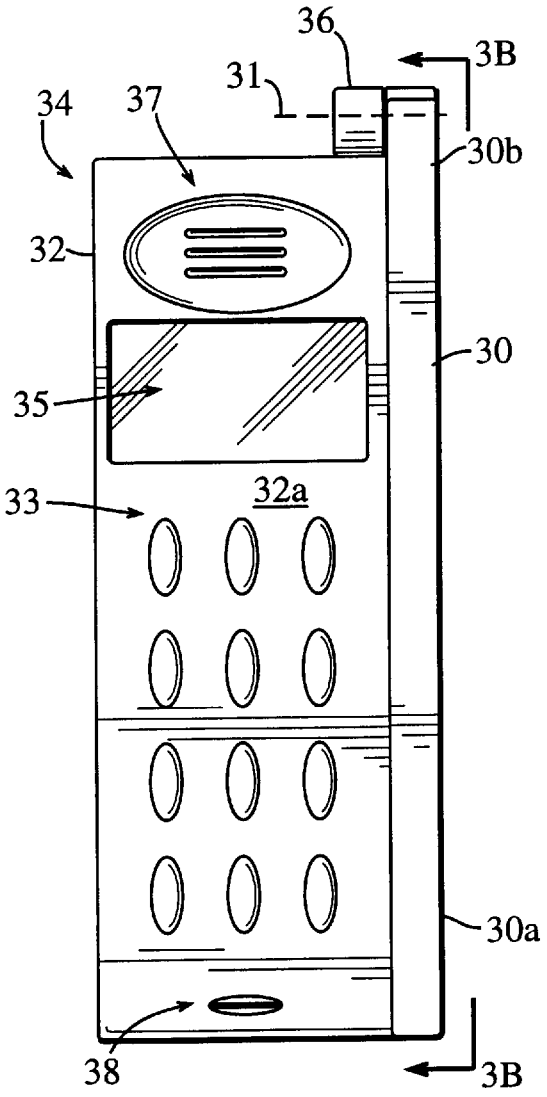
FIG. 3A (PRIOR ART)
FIG. 3A illustrates the swivel radiotelephone antenna of FIGS. 2A–2B in a stored position adjacent the radiotelephone housing.
Figure 3B:
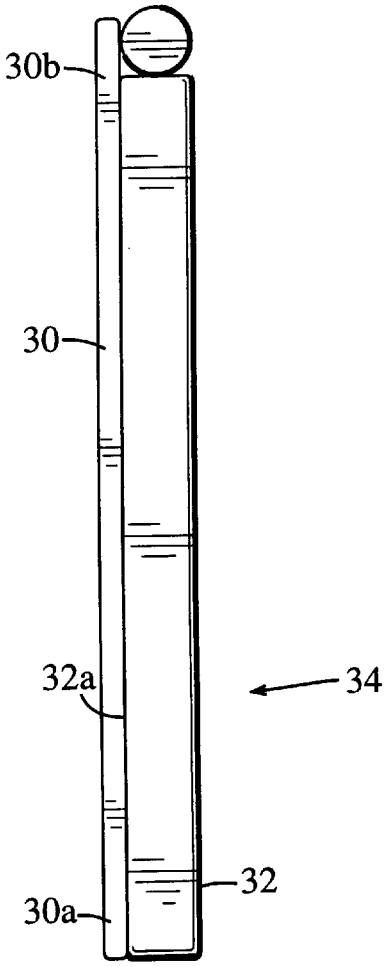
FIG. 3B (PRIOR ART)
FIG. 3B is a side elevational view of the antenna of FIG. 3A taken along lines 3B—3B.

Referring now to FIGS. 2A–2B and FIGS. 3A–3B, a conventional swivel antenna 30 is pivotally mounted to the housing 32 of a radiotelephone 34 via a hinge 36 that facilitates rotation of the antenna 30 from a stored position (FIGS. 3A–3B) to an operating position (FIGS. 2A–2B). In the operating position, the antenna 30 extends outwardly and away from the housing 32, as illustrated. In the stored position (FIGS. 3A–3B), the antenna 30 overlies the front surface 32*a* of the housing adjacent the keypad 33, display 35, speaker slots 37 and microphone slot 38, as illustrated. When the antenna 30 is in the stored position, the radiotelephone may be referred to as being in "paging" mode.

The illustrated antenna 30 has a generally rectangular configuration and includes a free end 30*a* and an opposite end 30*b* pivotally mounted to the housing via hinge 36. The antenna 30 may be formed from a dielectric material and may include one or more conductive elements 31 disposed on a face 29 of the antenna, or within the dielectric material, that serve as one or more radiating elements for transmitting and receiving radio frequency communications. When in the operational position (FIGS. 2A–2B), the antenna 30 may resonate as a quarter-wave or half-wave (or multiples thereof) antenna, as is understood by those skilled in this art.

The one or more conductive elements 31 on the antenna face 29 are electrically connected to a transceiver (not shown) within the radiotelephone housing 32, as would be known to those skilled in the art of radiotelephone communications, and need not be described further herein. In addition, an impedance matching section may be provided adjacent the pivotally mounted end 30*b*, as would be understood by those skilled in this art, to match the impedance of the antenna 30 when in the operating position (FIGS. 2A–2B).

Figure 4A:
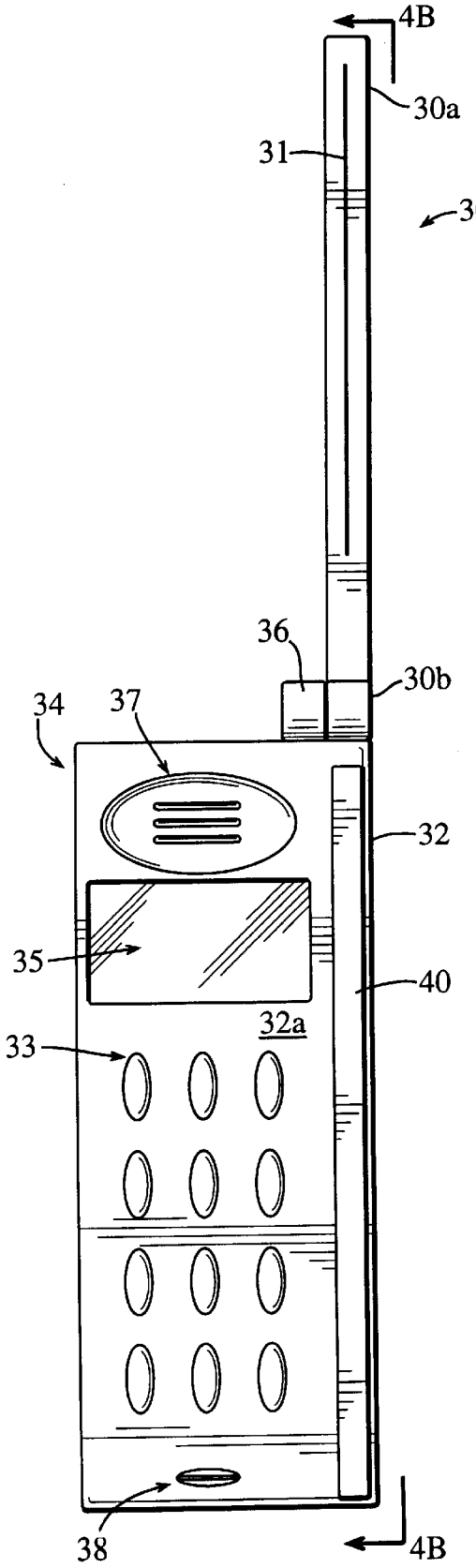
FIG. 4A illustrates a radiotelephone incorporating a parasitic tuning element according to an embodiment of the present invention, with the swivel antenna in an operational position.
Figure 4B:
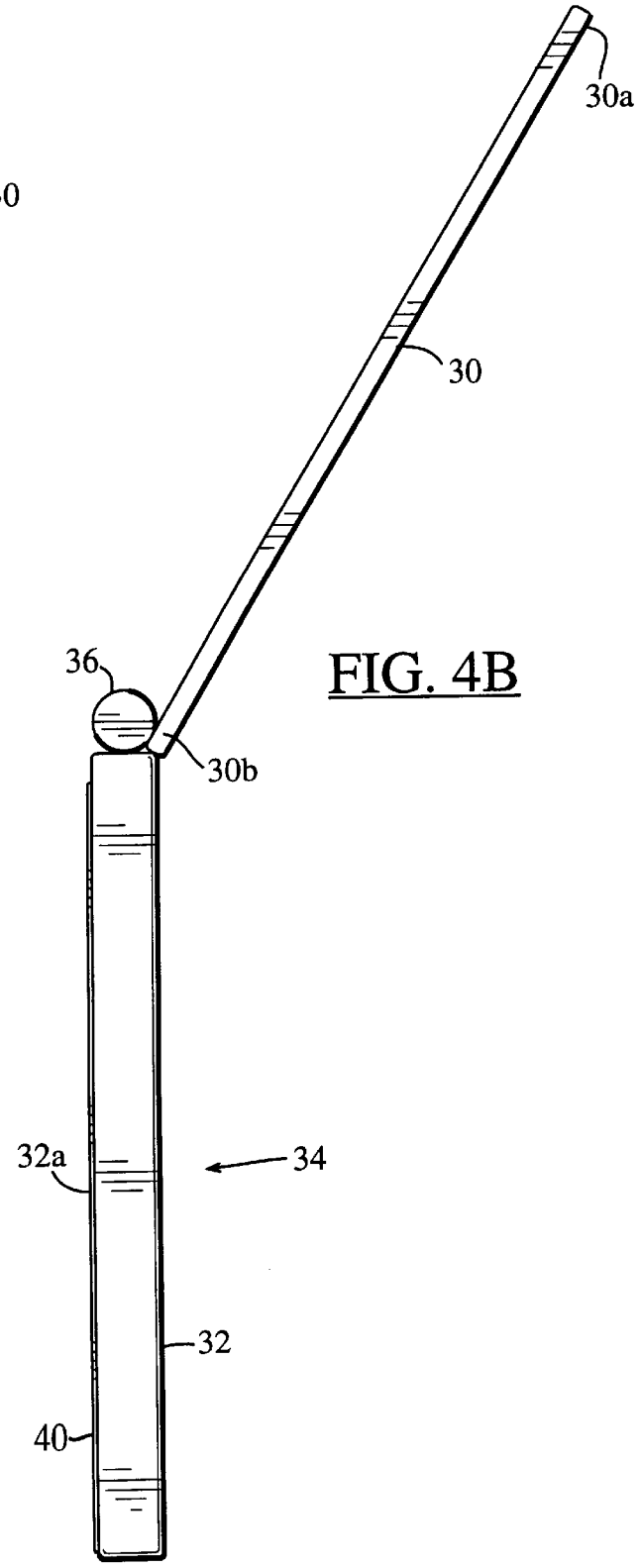
FIG. 4B is a side elevational view of the antenna of FIG. 4A taken along lines 4B—4B.
Figure 5A:
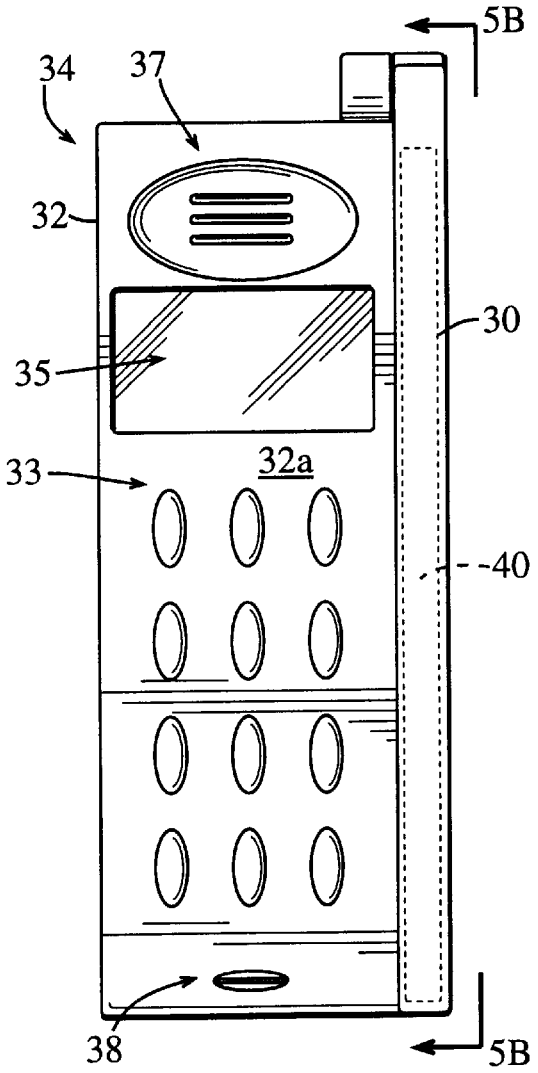
FIG. 5A illustrates the radiotelephone of FIGS. 4A–4B with the swivel antenna in a stored position adjacent the radiotelephone housing and overlying the parasitic tuning element.
Figure 5B:
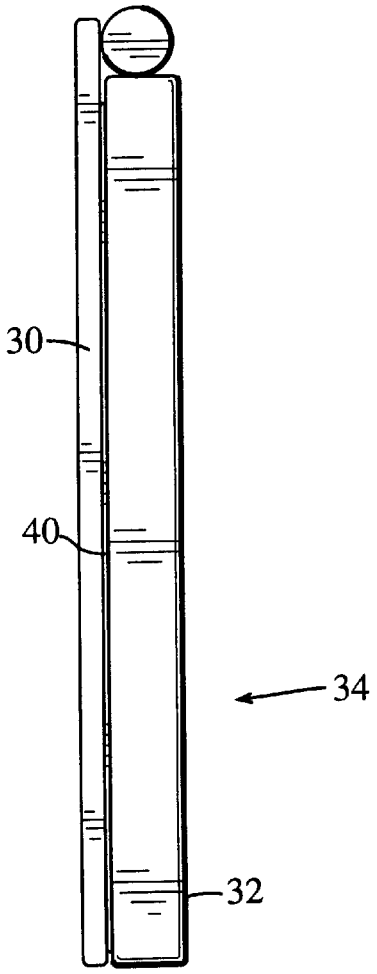
FIG. 5B is a side elevational view of the antenna of FIG. 5A taken along lines 5B—5B.

Referring now to FIGS. 4A–4B and FIGS. 5A–5B, a radiotelephone 34 incorporating a conductive, parasitic tuning element 40, according to an embodiment of the present invention, is illustrated. The parasitic tuning element 40 is disposed on the front surface 32*a* of the radiotelephone housing 32 adjacent the keypad 33, display 35, speaker slots 37 and microphone slot 38, as illustrated. The antenna 30 is configured to directly overlie the parasitic tuning element 40 when in the stored position, as illustrated in FIGS. 5A–5B.

As is known to those skilled in the art, parasitic electromagnetic elements are coupled to, and "feed off", near-field currents (i.e., currents flowing on a conductive surface exist in a "field" of electromagnetic fields that the currents induce in close proximity to the conductive surface). A parasitic antenna is an antenna that is not driven directly by an RF source, but rather, is excited by energy radiated by another source. The presence of a parasitic tuning element changes the resonant characteristics of a nearby antenna.

For example, when the illustrated antenna of FIGS. 5A–5B is in a stored position overlying the parasitic tuning element 40, the parasitic tuning element 40 couples with the antenna radiating elements 31 such that the resonant characteristics of the antenna radiating elements 31 are changed so that the antenna 30 remains operational. Accordingly, the antenna 30 can function as a quarter-wave or half-wave (or any multiples thereof) antenna both in the operating position and the stored position. The parasitic tuning element 40 prevents the antenna radiating element(s) 31 from becoming de-tuned by the close proximity to the housing 32. Because the parasitic tuning element 40 is located on, or near, the housing surface 32*a*, the parasitic tuning element 40 does not affect the performance of the antenna 30 when swiveled away from the housing to an operational position, as illustrated in FIGS. 4A and 4B.

Parasitic tuning elements used in accordance with the present invention are not limited to the illustrated embodiment of FIGS. 4A–4B and FIGS. 5A–5B. The illustrated parasitic tuning element 40 may be enclosed within the housing 32 or may be incorporated into the material of the housing 32. Preferably, the parasitic tuning element 40 is formed from conductive material including, but not limited to, metal plating, flex board traces and conductive polymers.

The shape and configuration of a parasitic tuning element, according to the present invention, is a tuning parameter and may vary according to the configuration and tuning performance of the radiating element or elements of an associated antenna. Exemplary alternative shapes and configurations are illustrated in FIGS. 6A–6B and FIGS. 7A–7B.

Figure 6A:
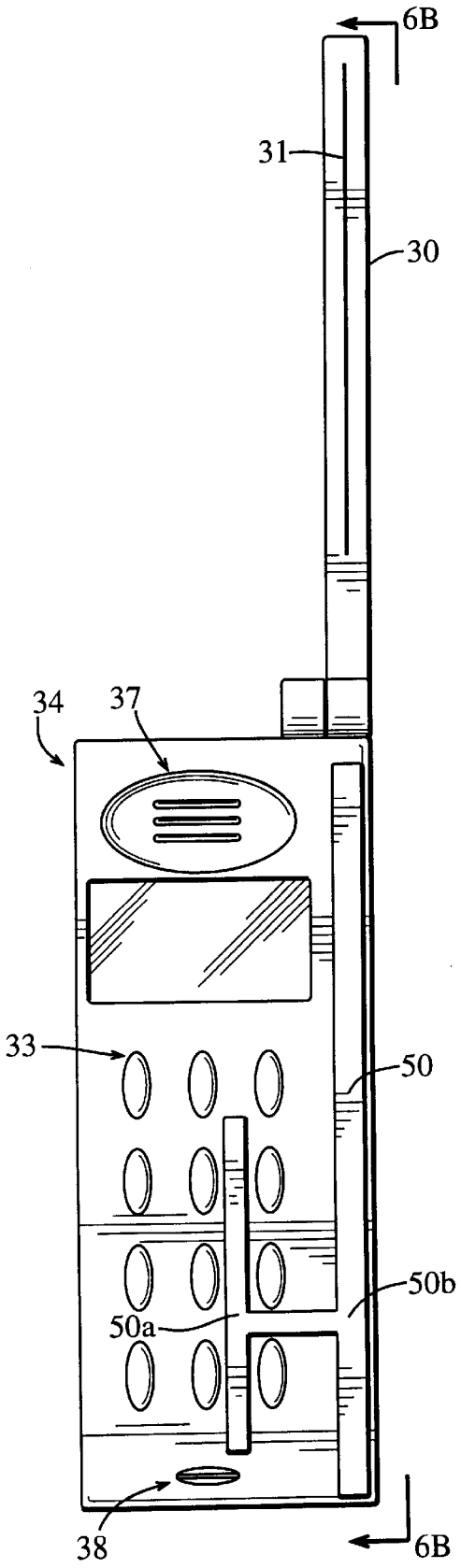
FIG. 6A illustrates a radiotelephone incorporating a parasitic tuning element according to another embodiment of the present invention, with the swivel antenna in an operational position.
Figure 6B:
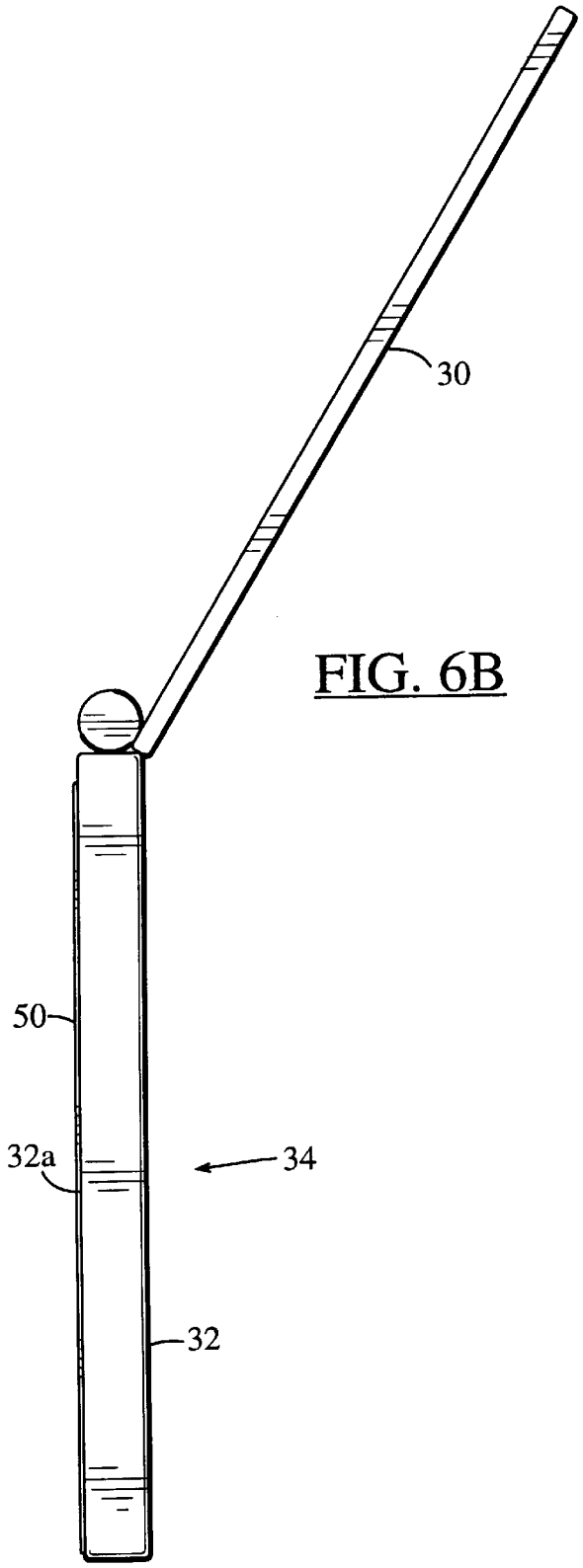
FIG. 6B is a side elevational view of the antenna of FIG. 6A taken along lines 6B—6B.
Figure 7A:
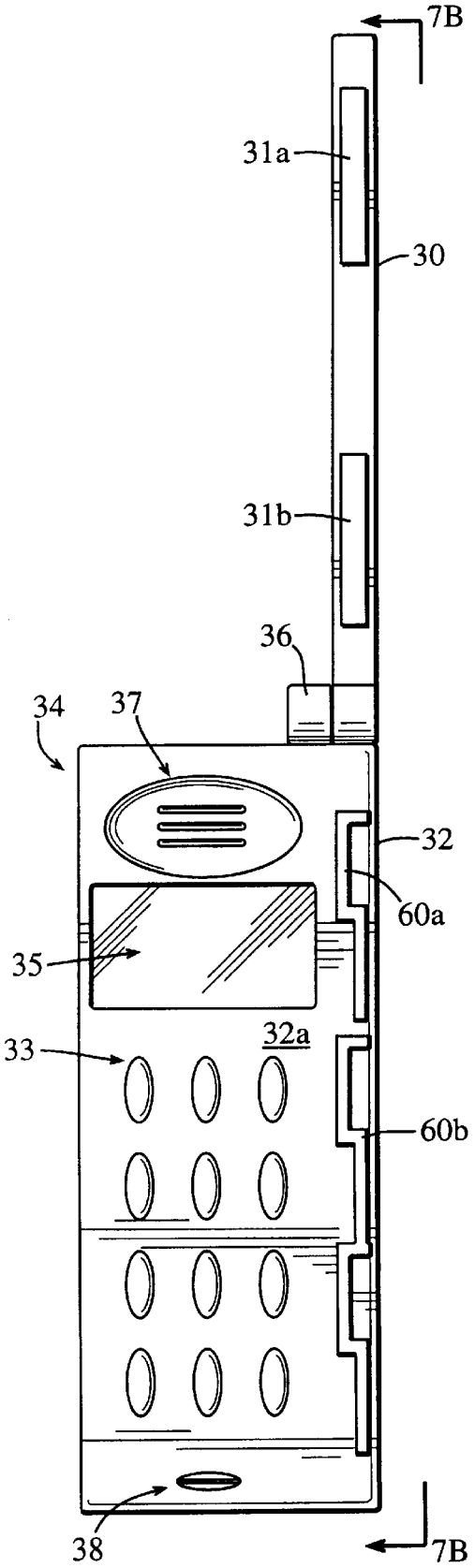
FIG. 7A illustrates a radiotelephone incorporating multiple parasitic tuning elements according to another embodiment of the present invention, with the swivel antenna in an operational position.
Figure 7B:
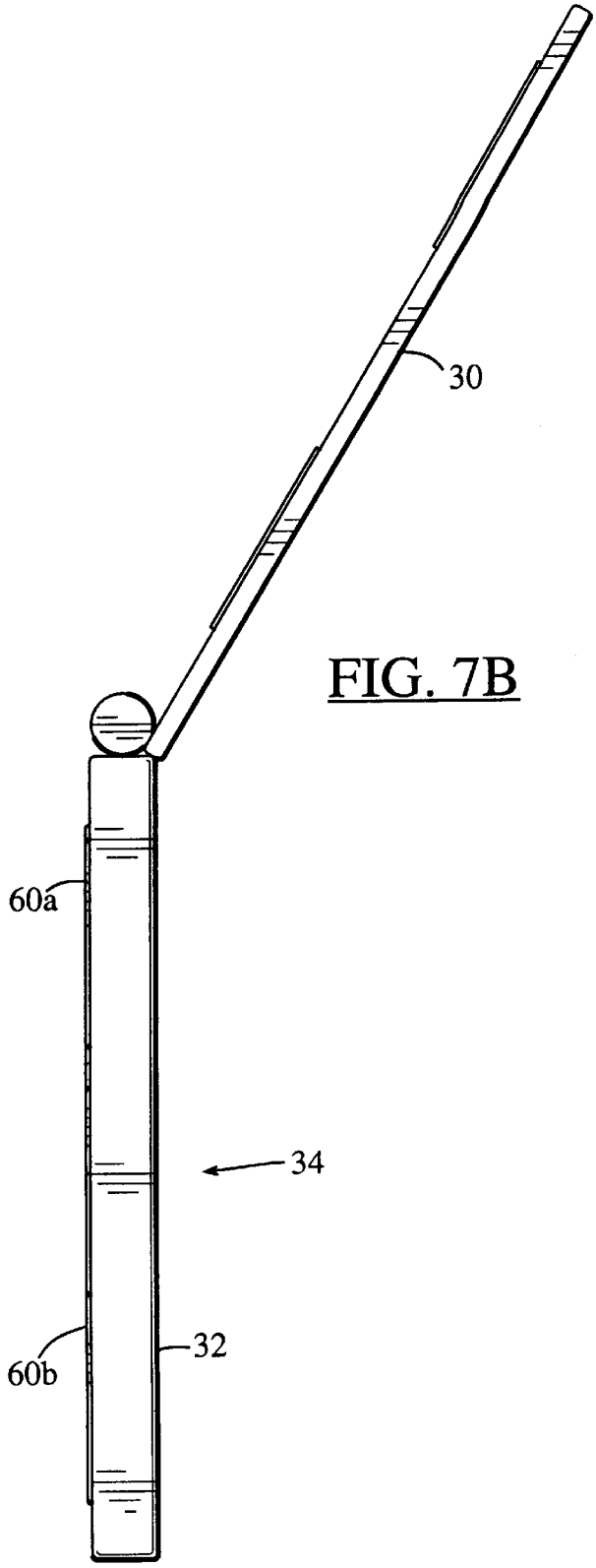
FIG. 7B is a side elevational view of the antenna of FIG. 7A taken along lines 7B—7B.

FIGS. 6A–6B illustrate a parasitic tuning element 50 having a portion 50*a* meandering between the keys of the keypad 33. The radiating element 31 of the antenna 30 overlies a portion 50*b* of the antenna that is adjacent the keypad 33, display 35, speaker slots 37 and microphone slot 38, as illustrated, when the antenna 30 is in a stored position. As illustrated in FIGS. 7A–7B, multiple parasitic tuning elements 60*a*, 60*b* may be used with multiple respective antenna radiating elements 31*a* and 31*b*.

Figure 8A:
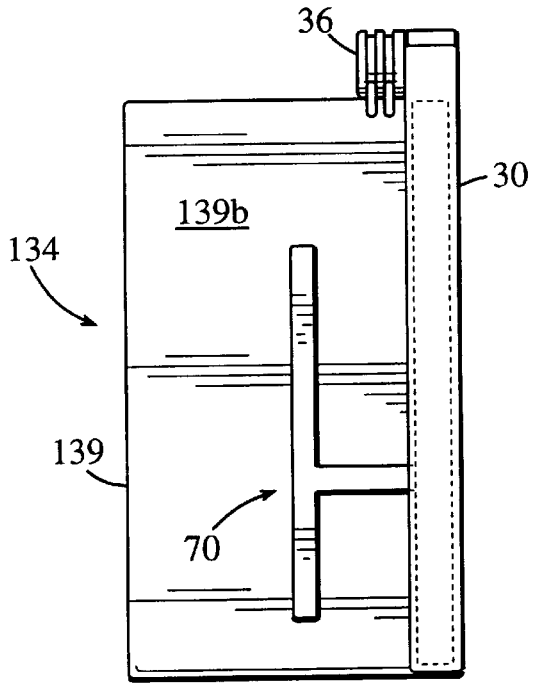
FIG. 8A illustrates a "flip-style" radiotelephone with a parasitic tuning element incorporated into the flip cover and a separate swivel antenna, wherein the flip cover and swivel antenna are in stored positions with the swivel antenna overlying the parasitic tuning element.
Figure 8B:
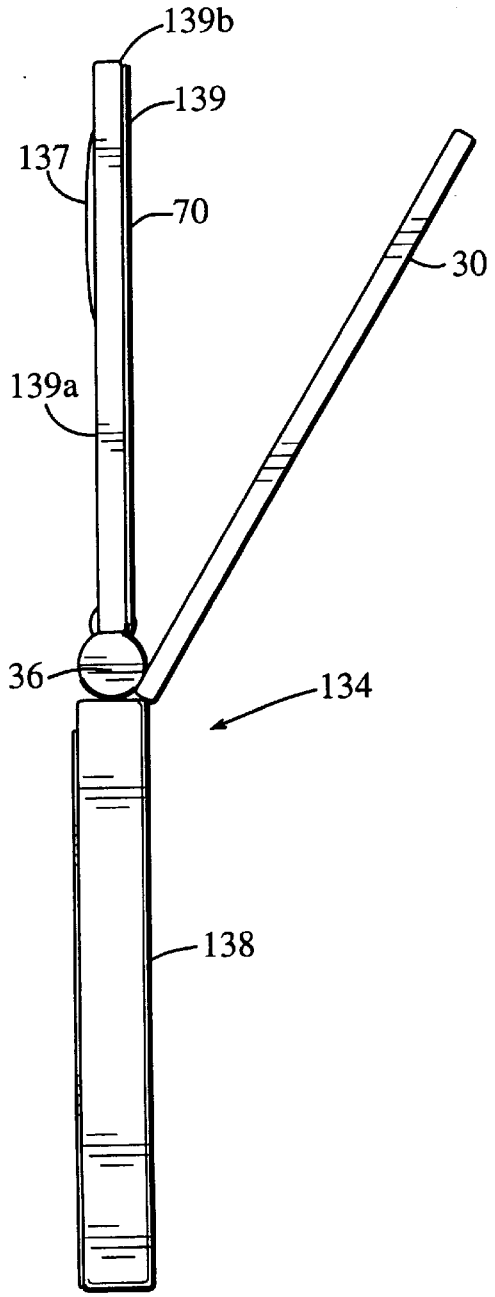
FIG. 8B illustrates the radiotelephone of FIG. 8A with the flip and swivel antenna in respective operational positions.

Referring now to FIGS. 8A–8B, a "flip-style" radiotelephone 134 incorporating a parasitic tuning element 70 according to another embodiment of the present invention is illustrated. The illustrated radiotelephone 134 includes a flip cover 139 that houses a speaker 137, and a bottom handset portion 138 pivotally connected thereto via hinge 36. The flip cover 139 includes opposite front and back surfaces 139*a*, 139*b* and is hinged to one end of the bottom handset portion 138, as illustrated. The parasitic tuning element 70 is disposed on the back surface 139*b* of the flip cover 139, as illustrated.

In operation, the flip cover 139 and antenna 30 may be pivoted by a user between closed (FIG. 8A) and open (Fig. 8B) positions. When in a closed position, the flip cover 139 overlies the bottom handset housing 138. The antenna 30, when in a stored position, pivots down upon the flip portion back surface 139*b* so that antenna radiating elements (not shown) overlie a portion of the parasitic tuning element 70. Accordingly, the antenna 70 can remain operational even when the antenna 30 is in the stored position.

Figure 9A:
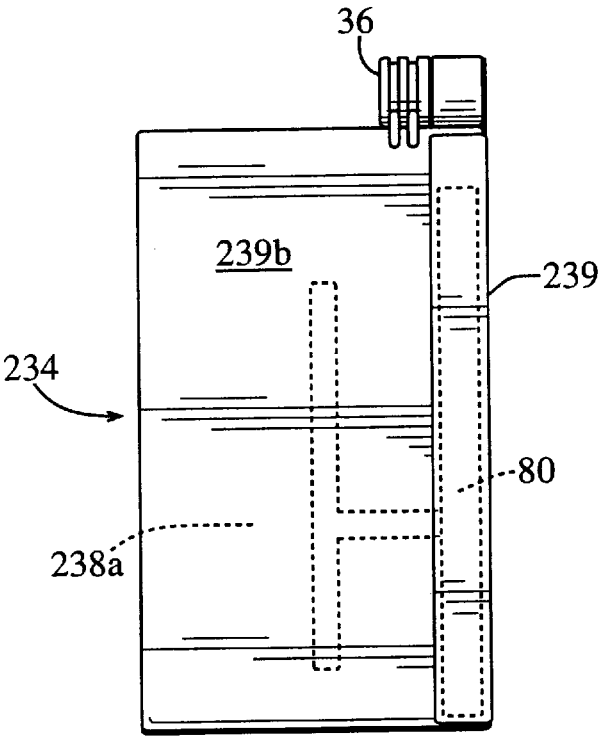
FIG. 9A illustrates a "flip-style" radiotelephone with a parasitic tuning element incorporated into the housing and an antenna incorporated into the flip cover, wherein the flip cover is in a stored position such that the swivel antenna overlies the parasitic tuning element.
Figure 9B:
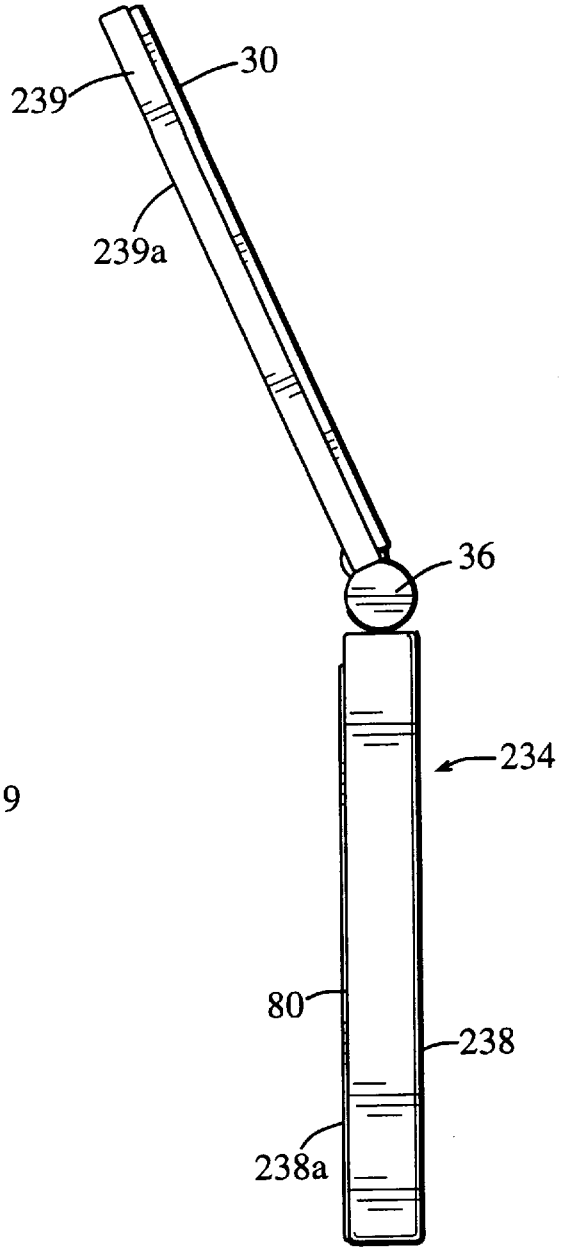
FIG. 9B illustrates the radiotelephone of FIG. 9A with the flip cover and antenna incorporated therein in an operational position.

Referring now to FIGS. 9A–9B, another "flip-style" radiotelephone 234 incorporating a parasitic tuning element 80 according to another embodiment of the present invention is illustrated. The illustrated radiotelephone 234 includes a flip cover 239 that houses a speaker (not shown) and an antenna 30. The flip cover 239 is pivotally connected to a bottom handset portion 238 via hinge 36, as illustrated. The flip cover 239 includes opposite front and back surfaces 239*a*, 239*b*. A parasitic tuning element 80 is disposed on the front surface 238*a* of the bottom handset portion 238, as illustrated.

In operation, the flip cover 239 may be pivoted by a user between closed (FIG. 9A) and open (FIG. 9B) positions. When in a closed position, the flip cover 239 is in adjacent overlying relationship with the bottom handset housing 238 such that the antenna 30 and any radiating element or elements thereon overlie the parasitic tuning element 80. Accordingly, the antenna 30 can remain operational even when the flip cover 239 is in the closed position.

The foregoing is illustrative of the present invention and is not to be construed as limiting thereof. Although a few exemplary embodiments of this invention have been described, those skilled in the art will readily appreciate that many modifications are possible in the exemplary embodiments without materially departing from the novel teachings and advantages of this invention. Accordingly, all such modifications are intended to be included within the scope of this invention as defined in the claims. Therefore, it is to be understood that the foregoing is illustrative of the present invention and is not to be construed as limited to the specific embodiments disclosed, and that modifications to the disclosed embodiments, as well as other embodiments, are intended to be included within the scope of the appended claims. The invention is defined by the following claims, with equivalents of the claims to be included therein.

That which is claimed is:

1. An antenna system for an electronic device, said electronic device comprising a housing enclosing a receiver that receives wireless communication signals, wherein said housing includes a front surface and opposite elongated side portions, and wherein a keypad is disposed on said housing front surface, said antenna system comprising:

an elongated antenna movably mounted to said housing between said elongated side portions such that said elongated antenna pivots along a predetermined path of rotation from a stored position between said keypad and a housing elongated side portion to an operating position extended away from said housing, wherein said elongated antenna covers a portion of said housing front face between said keypad and said side portion when said elongated antenna is in said stored position, wherein said elongated antenna is in electrical communication with said receiver; and at least one parasitic tuning element disposed on said housing front surface so as to be located adjacent said elongated antenna when said elongated antenna is in said stored position and to couple to said elongated antenna to tune said elongated antenna when said elongated antenna is in said stored position.

2. An antenna system according to claim 1, wherein said elongated antenna comprises a dielectric substrate including a face and a radiating element disposed on said face.

3. An antenna system according to claim 2, wherein said dielectric substrate face overlies a portion of said at least one parasitic tuning element when said elongated antenna is in said stored position.

4. An antenna system according to claim 1, wherein said at least one parasitic tuning element is disposed within said housing.

5. An antenna system according to claim 1, wherein said antenna is a half-wave antenna in said operating position.

6. An antenna system according to claim 1, wherein said elongated antenna is a quarter-wave antenna in said operating position.

7. An antenna system according to claim 1, wherein said at least one parasitic tuning element comprises a plurality of parasitic tuning elements.

8. An antenna system according to claim 1, wherein said at least one parasitic tuning element is configured to have a meandering, electrically conductive path.

9. A multiple frequency band antenna system for an electronic device, said electronic device comprising a housing enclosing a transceiver for transmitting and receiving wireless communication signals, said multiple frequency band antenna system comprising:

a dielectric substrate movably mounted to said housing and configured to pivot along a predetermined path of rotation from a stored position adjacent said housing to an operating position extended away from said housing;

first and second radiating elements disposed on said dielectric substrate, said first and second radiating elements in electrical communication with said transceiver;

first and second parasitic tuning elements disposed on said housing so as to be located adjacent said respective first and second radiating elements when said dielectric substrate is in said stored position;

wherein said first parasitic tuning element is coupled to said first radiating element to tune said first radiating element to a first frequency band and to match an impedance of said first radiating element with an impedance of said transceiver when said dielectric substrate is in said stored position; and wherein said second parasitic tuning element is coupled to said second radiating element to tune said second radiating element to a second frequency band and to match an impedance of said second radiating element with an impedance of said transceiver when said dielectric substrate is in said stored position.

10. A multiple frequency band antenna system according to claim 9, wherein said first and second radiating elements overlie respective portions of said first and second parasitic tuning elements when said dielectric substrate is in said stored position.

11. A multiple frequency band antenna system according to claim 9, wherein said first and second parasitic tuning elements are disposed within said housing.

12. A multiple frequency band antenna system according to claim 9, wherein at least one of said first and second radiating elements radiates as a respective half-wave antenna when said dielectric substrate is in said operating position.

13. A multiple frequency band antenna system according to claim 9, wherein at least one of said first and second radiating elements radiates as a quarter-wave antenna when said dielectric substrate is in said operating position.

14. A multiple frequency band antenna system according to claim 9, wherein said first and second parasitic tuning elements are configured to have respective meandering, electrically conductive paths.

15. A radiotelephone, comprising:

a housing enclosing a transceiver for transmitting and receiving radiotelephone communication signals, wherein said housing includes a front surface and opposite elongated side portions;

a keypad disposed on said housing front surface; and an antenna system comprising:

an elongated antenna movably mounted to said housing between said elongated side portions such that said elongated antenna pivots along a predetermined path of rotation from a stored position between said keypad and a housing elongated side portion to an operating position extended away from said housing, wherein said elongated antenna covers a portion of said housing front face between said keypad and said side portion when said elongated antenna is in said stored position, wherein said antenna is in electrical communication with said transceiver; and at least one parasitic tuning element disposed on said housing front surface so as to be located adjacent said elongated antenna when said elongated antenna is in said stored position, said at least one parasitic tuning element coupled to said elongated antenna to tune said elongated antenna to a first frequency band and to match an impedance of said elongated antenna with an impedance of said transceiver when said elongated antenna is in said stored position.

16. A radiotelephone according to claim 15, wherein said elongated antenna comprises a dielectric substrate including a face and a radiating element disposed on said face.

17. A radiotelephone according to claim 16, wherein said dielectric substrate face overlies a portion of said at least one parasitic tuning element when said elongated antenna is in said stored position.

18. A radiotelephone according to claim 15, wherein said at least one parasitic tuning element is disposed within said housing.

19. A radiotelephone according to claim 15, wherein said elongated antenna is a half-wave antenna in said operating position.

20. A radiotelephone according to claim 15, wherein said elongated antenna is a quarter-wave antenna in said operating position.

21. A radiotelephone according to claim 15, wherein said at least one parasitic tuning element comprises a plurality of parasitic tuning elements.

22. A radiotelephone according to claim 15, wherein said at least one parasitic tuning element is configured to have a meandering, electrically conductive path.

23. A radiotelephone, comprising:

a housing enclosing a transceiver for transmitting and receiving radiotelephone communication signals, wherein said housing includes a front surface and opposite elongated side portions;

a keypad disposed on said housing front surface;

a flip cover hinged to said housing between said elongated side portions and movable between a closed position wherein said flip cover overlies at least a portion of said housing front surface, and an open position wherein said housing front surface is uncovered; and an antenna system, comprising:

an elongated antenna disposed on said flip cover and in electrical communication with said transceiver, wherein said elongated antenna overlies only a portion of the housing front surface that extends between said keypad and an elongated side portion of said housing when said flip cover is in said closed position; and at least one parasitic tuning element disposed on said portion of the housing front surface between said keypad and an elongated side portion so as to be located adjacent said elongated antenna when said flip cover is in said closed position, said parasitic tuning element coupled to said elongated antenna to tune said elongated antenna to a first frequency band and to match an impedance of said elongated antenna with an impedance of said transceiver when said flip cover is in said closed position.

24. A radiotelephone according to claim 23, wherein said elongated antenna overlies a portion of said at least one parasitic tuning element when said flip cover is in said closed position.

25. A radiotelephone according to claim 23, wherein said at least one parasitic tuning element is disposed within said housing.

26. A radiotelephone according to claim 23, wherein said elongated antenna is a half-wave antenna when said flip cover is in said open position.

27. A radiotelephone according to claim 23, wherein said elongated antenna is a quarter-wave antenna when said flip cover is in said open position.

28. A radiotelephone according to claim 23, wherein said at least one parasitic tuning element comprises a plurality of parasitic tuning elements.

29. A radiotelephone according to claim 23, wherein said at least one parasitic tuning element is configured to have a meandering, electrically conductive path.

30. A radiotelephone, comprising:

a housing enclosing a transceiver for transmitting and receiving radiotelephone communication signals, said housing including a face;

a flip cover hinged to said housing and movable between a closed position wherein said flip cover overlies at least a portion of said housing face, and an open position wherein said housing face is uncovered;

at least one parasitic tuning element disposed within said flip cover;

an antenna movably mounted to said housing such that said antenna pivots along a predetermined path of rotation from a stored position overlying said flip cover when said flip cover is in said closed position to an operating position extended away from said housing and spaced apart from said flip cover when said flip cover is in said open position, wherein said antenna is in electrical communication with said transceiver; and wherein said at least one parasitic tuning element is disposed on said flip cover so as to be located adjacent said antenna when said antenna is in said stored position, said at least one parasitic tuning element coupled to said antenna to tune said antenna to a first frequency band and to match an impedance of said antenna with an impedance of said transceiver when said flip cover is in said stored position.

31. A radiotelephone according to claim 30, wherein said antenna comprises a dielectric substrate including a face and a radiating element disposed on said face.

32. A radiotelephone according to claim 31, wherein said dielectric substrate face overlies a portion of said at least one parasitic tuning element when said antenna is in said stored position.

33. A radiotelephone according to claim 30, wherein said at least one parasitic tuning element is disposed within said flip cover face.

34. A radiotelephone according to claim 30, wherein said antenna is a half-wave antenna in said operating position.

35. A radiotelephone according to claim 30, wherein said antenna is a quarter-wave antenna in said operating position.

36. A radiotelephone according to claim 30, wherein said at least one parasitic tuning element comprises a plurality of parasitic tuning elements.

37. A radiotelephone according to claim 30, wherein said at least one parasitic tuning element is configured to have a meandering, electrically conductive path.

* * * * *

UNITED STATES PATENT AND TRADEMARK OFFICE

CERTIFICATE OF CORRECTION

PATENT NO. : 5,943,021

DATED : August 24, 1999

INVENTOR(S) : Hayes et al.

It is certified that error appears in the above-identified patent and that said Letters Patent is hereby corrected as shown below:

In the Claims:

Column 7, line 32, insert - - elongated - - before "antenna".

Signed and Sealed this

Thirteenth Day of June, 2000

*Attest:*

Q. TODD DICKINSON

*Attesting Officer*

*Director of Patents and Trademarks*